US008261372B2

(12) United States Patent
Drab et al.

(10) Patent No.: US 8,261,372 B2
(45) Date of Patent: Sep. 11, 2012

(54) GOLF GLOVE

(75) Inventors: John Drab, Pasadena, MD (US); Tim Dennis, Bowie, MD (US); Raphael Peck, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 493 days.

(21) Appl. No.: 12/268,087

(22) Filed: Nov. 10, 2008

(65) Prior Publication Data

US 2009/0139008 A1 Jun. 4, 2009

Related U.S. Application Data

(60) Provisional application No. 61/002,665, filed on Nov. 9, 2007.

(51) Int. Cl.
*A63B 71/14* (2006.01)

(52) U.S. Cl. ..... 2/161.3; 2/161.2; 2/161.1

(58) Field of Classification Search ..... 2/20, 159, 2/160, 161.1, 161.2, 161.3, 161.6, 161.8, 2/167, 168
See application file for complete search history.

(56) References Cited

U.S. PATENT DOCUMENTS 5,423,089 A 6/1995 Chun et al.
5,644,795 A 7/1997 Landis et al.
5,926,847 A 7/1999 Eibert
5,983,395 A * 11/1999 Lei ..... 2/159
6,044,494 A * 4/2000 Kang ..... 2/167
6,209,138 B1 * 4/2001 Kang ..... 2/167
6,408,442 B1 * 6/2002 Kang ..... 2/167
6,675,392 B2 * 1/2004 Albert ..... 2/161.1
D549,397 S * 8/2007 VanErmen ..... D29/113
D560,037 S * 1/2008 VanErmen ..... D29/117.2
D560,040 S * 1/2008 VanErmen ..... D29/117.2
D594,159 S * 6/2009 Drab et al. ..... D29/117.2
7,625,625 B2 * 12/2009 Rios et al. ..... 428/141
2007/0148409 A1 * 6/2007 Rios et al. ..... 428/167
2009/0162651 A1 * 6/2009 Rios et al. ..... 428/354
2010/0077526 A1 * 4/2010 Smeltzer ..... 2/16
2010/0183814 A1 * 7/2010 Rios et al. ..... 427/387

* cited by examiner

*Primary Examiner* — Khoa Huynh
*Assistant Examiner* — Sally Haden
(74) *Attorney, Agent, or Firm* — Maginot, Moore & Beck

(57) ABSTRACT

A golf glove comprises a palm portion and a plurality of digits comprised of a first material. A plurality of grip pads of a second material such as silicone is provided on the digits and/or the palm portion. The grip pads comprise a plurality of bumps having geometric shapes. In at least one embodiment, the bumps are hexagonal in shape. The bumps may be provided directly on the first material of the glove or may be provided on a thin base layer. The bumps are arranged on the glove such that they contact the grip of a golf club when the golf club is gripped by a golfer. Accordingly, the bumps may be positioned on tip portions of the fingers and thumb and also along a line extending between a hypothenar region of the palm and a portion of the palm located between the finger and thumb.

16 Claims, 3 Drawing Sheets

GOLF GLOVE

CROSS-REFERENCE TO RELATED APPLICATIONS

This application claims priority from U.S. provisional patent application No. 61/002,665, filed Nov. 9, 2007, the contents of which are incorporated herein by reference.

FIELD

The present application relates to field of golf, and particularly, to golf gloves.

BACKGROUND

In the game of golf, a golfer will typically wear a golf glove on at least one hand when a full swing is to be made with a golf club. The golf glove not only protects the golfer's hand from the stress associated with swinging the golf club, it also helps the user grip the golf club.

Golf gloves are typically made of a relatively thin leather or synthetic leather material. Over time, the stress of the club rubbing against the golf glove will cause the leather glove to wear. Wear often shows in the form of holes in the golf glove at particular stress points.

In addition, golf gloves are typically exposed to moisture, heat, and cold. Over time, these influences cause the material of the golf glove to degrade and loose its soft, supple feel. Also, when the material of the golf glove degrades, it tends to become dry and slick, causing the glove to loose its ability to assist the golfer in gripping a golf club.

Accordingly, it would be advantageous to provide a golf glove having improved durability such that it resists wear. In addition, it would be advantageous to provide a golf glove that provides increased gripping ability for the golfer, even after the golf glove has been exposed to moisture, heat and cold over prolonged periods.

SUMMARY

A golf glove comprises a palm portion and a plurality of digits comprised of a first material. A plurality of grip pads of a second material is provided on the digits and/or the palm portion. The grip pads provide a surface with an increased coefficient of friction over that of the first material when a golf club is gripped using the golf glove.

In at least one embodiment, the grip pads of the golf glove are comprised of a silicone material. The grip pads comprise a plurality of bumps having geometric shapes. The bumps may be provided directly on the first material of the glove or may be provided on a thin base layer of silicone. The plurality of bumps on the thin base layer provide surface irregularities in the golf glove intended to assist the golfer in gripping a golf club. The bumps are arranged on the glove such that they contact the grip of a golf club when the golf club is gripped by a golfer. Accordingly, the bumps may be positioned on tip portions of the fingers and thumb and also along a line extending between a hypothenar region of the palm and a portion of the palm located between the finger and thumb.

The above described features and advantages, as well as others, will become more readily apparent to those of ordinary skill in the art by reference to the following detailed description and accompanying drawings.

DESCRIPTION

Figure 1:
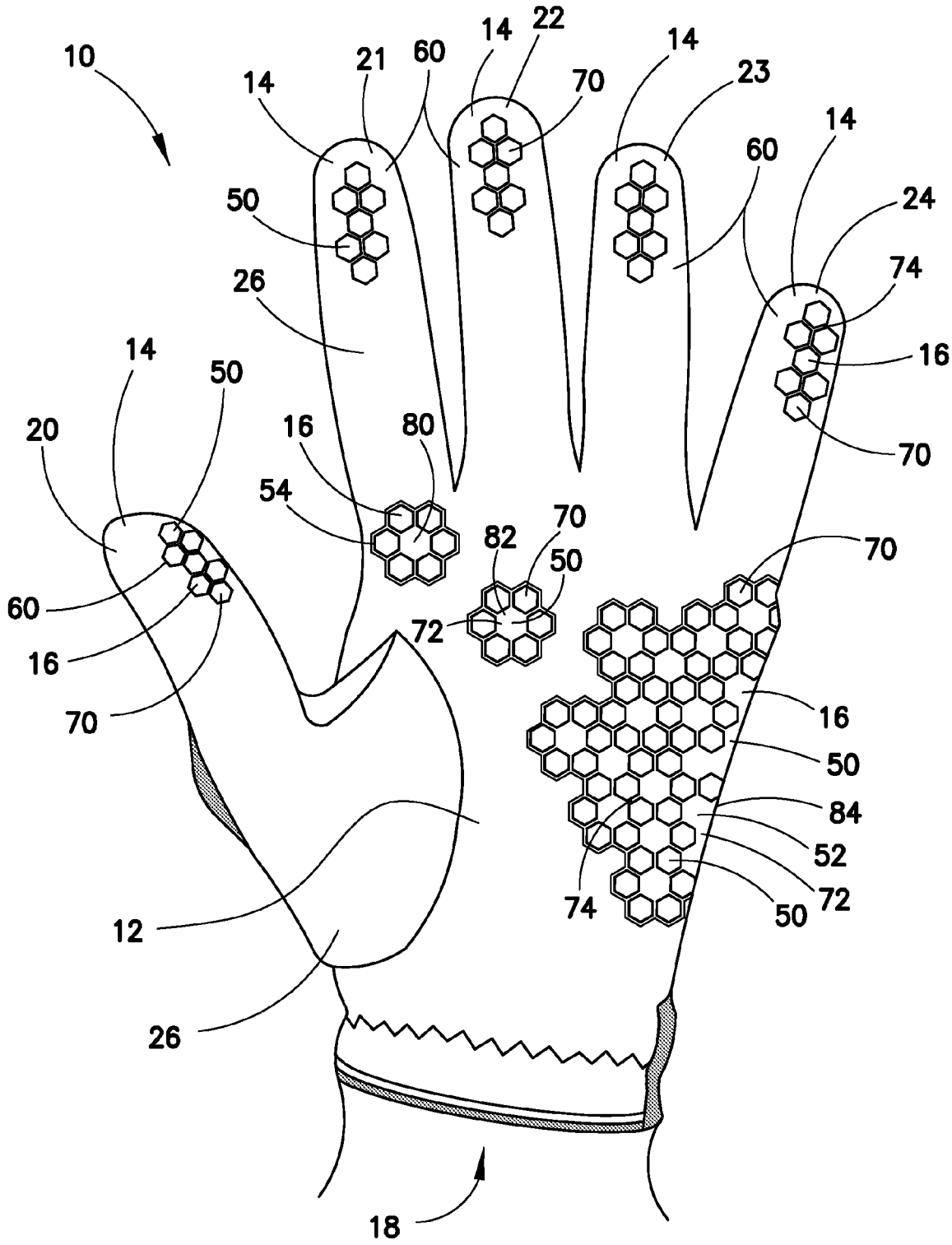
FIG. 1 shows a perspective view of a palm side of a golf glove.

A golf glove comprises a palm side, a back side, and an opening configured to receive a golfer's hand. FIG. 1 shows the palm side of the golf glove 10 with the opening 18 provided at the bottom portion of the glove 10. The palm side of the golf glove 10 includes a palm portion 12 with a plurality of digits 14 extending from the palm portion 12. A plurality of grip pads 50 are provided on the digits 14 and/or the palm portion 12 of the golf glove 10.

The palm portion 12 of the golf glove 10 is positioned on the palm side (which may also be referred to herein as a forehand side) of the golf glove. The palm portion 12 is configured to fit against a golfer's palm when his or her hand is fully inserted into the glove 10 through the opening 18. The palm portion 12 is generally comprised of a synthetic leather material 26, such as a micro-capsulated synthetic leather. However, it will be recognized that the palm portion 12 could also be comprised of a leather material or any other material suitable for use as a golf glove.

The digits 14 extend from the palm portion on the forehand side, the digits 14 configured to receive the golfer's thumb and fingers. Accordingly, the digits 14 include a thumb member 20, and four finger members 21, 22, 23 and 24. Like the palm portion 12, the digits 14 are also generally comprised of a synthetic leather material 26, such as a micro-capsulated synthetic leather. Again, it will be recognized that the digits could also be comprised of a leather material or any other material suitable for use as a golf glove.

Figure 2:
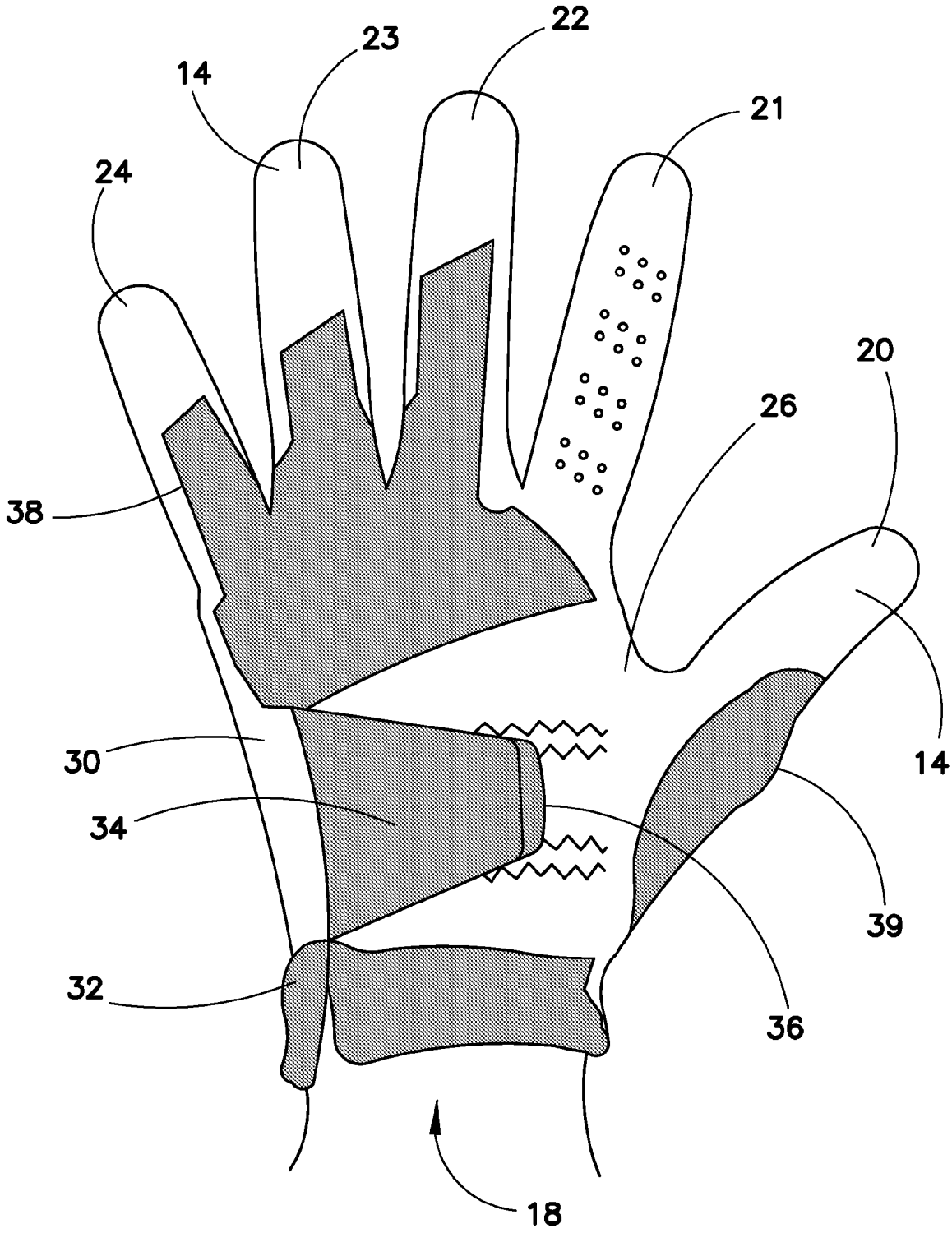
FIG. 2 shows a perspective view of a back side of the golf glove of FIG. 1.

With reference now to FIG. 2, the back side 30 (which may also be referred to as a backhand side) of the golf glove 10 is shown. The back side 30 of the golf glove includes a slit 32 which allows the opening 18 to be enlarged to assist the golfer in getting his or her hand into the glove 10. A flap 34 and mat 36 arrangement is also provided in relation to the slit 32. The flap 34 includes a hook and loop material, such as Velcro®, configured to engage a complimentary hook and loop material on the mat 36. As will be recognized, the golfer may easily remove the flap 34 from the mat 36 to maximize the length of the slit 32 when placing his or her hand in the glove 10. The golfer may then bring the flap 34 into engagement with the mat 36 to minimize the length of the slit 32, in order to tighten the glove on the golfer's hand.

Like the palm 12 and digits 14 of the glove 10, the back side 30 of the glove 10 is generally comprised of a synthetic leather material such as a micro-capsulated leather. In addition, the back side of the glove 10 may also include one or more portions comprised of a material different from other portions of the glove 10. For example, the knuckle portions 38, 39 on the back side 30 of the golf glove 10 may be comprised of a polyester material, such as the HEATGEAR® polyester material sold on goods produced by Under Armour, Inc. This polyester material provides the golfer with a comfortable and breathable fabric that provides moisture management and temperature regulation in the golf glove 10. The material may also be stretchable to provide increased range of motion for the golfer when the golfer grips a golf club. It will be recognized that other materials may be provided on the front or back side 30 of the golf glove 10, depending on the design of the glove and desired characteristics.

Returning again to FIG. 1, the palm portion 12 and digits 14 of the golf glove further include a plurality of grip pads 50. The grip pads 50 provide areas of increased grip quality over other areas of the golf glove when a golfer wearing the glove grips a golf club grip. In particular, when a golfer takes hold of a golf club grip, such as club grips comprised of leather, synthetic leather, rubber or plastic material, the grip pads 50 provide areas having an increased coefficient of friction over other areas of the golf glove 10 that may be used to grip the golf club. In the disclosed embodiment of FIG. 1, the grip pads 50 provide an increased coefficient of friction over the synthetic leather material provided on the palm portion 12 and digits 14. With these grip pads 50 provided on the golf glove 10, the golfer tends to experience e increased gripping ability and club control than would be experienced without such grip pads.

In at least one embodiment, the grip pads 50 are preferably comprised of silicone. However, it will be recognized that other materials may be utilized for the grip pads, and various methods may be used to provide the grip pads. For example, in one alternative embodiment, the grip pads 50 may be comprised of a PVC material or some other material instead of a silicone material. Exemplary methods for providing the grip pads include heat press, embroidery, or laser etching.

In addition to providing for increased grip qualities, the grip pads 50 may also provide other advantages. For example, the grip pads 50 may also provide areas of increased durability and wear characteristics for the golf glove. In particular, the grip pads will tend to wear longer and will generally be more durable than the other material provided on the golf glove, such as a leather or synthetic leather material. Thus, the golf glove will not develop holes at the grip pads 50 as fast as if the areas covered by the grip pads were comprised of leather or synthetic leather.

Another advantage provided by the grip pads 50 is that of increased club feel. Furthermore, the arrangement of the grip pads 50 on the glove may be used to provide the golfer with an indication of the proper grip position and help the golfer grip the club properly.

In addition to the above, in one alternative embodiment, another advantage may be realized if the material used for the grip pads provides the golfer with a better grip in wet conditions. PVC is one example of a material that may be used to provide such increased grip in wet conditions. Of course, it will be recognized that numerous other materials may be used to provide the golfer with a better grip in wet conditions.

Figure 3:
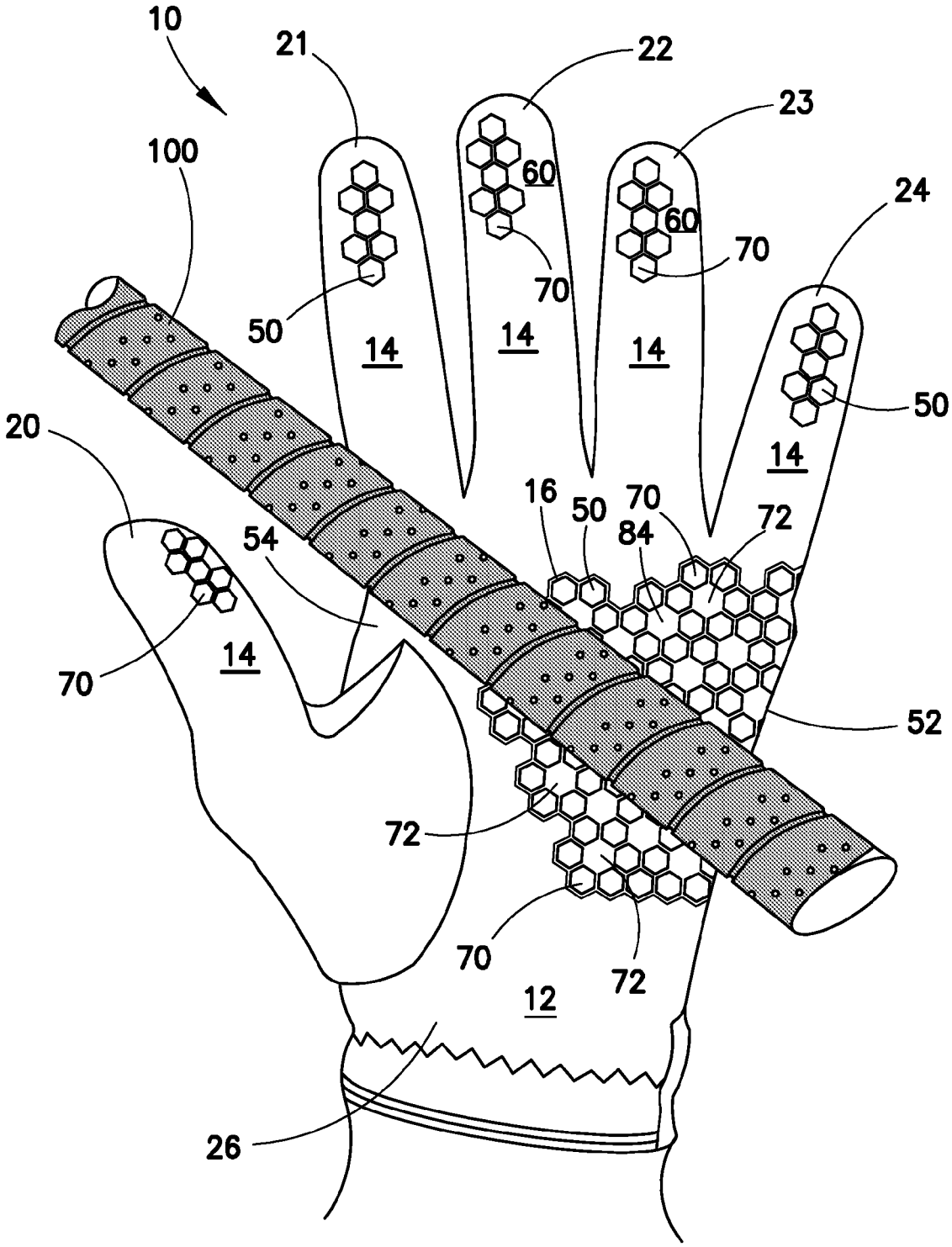
FIG. 3 shows a perspective view of the golf glove of FIG. 1 with the grip of a golf glove positioned along grip pads of the golf glove.

With reference now to the embodiment of FIGS. 1 and 3, it can be seen that the grip pads 50 are located on the golf glove 10 in locations such that the grip pads will contact the grip 100 of a golf club when a golfer takes hold of the golf club grip 100 using a conventional grip. Accordingly, the plurality of grip pads 50 are positioned on the palm portion 12 along an area that extends between a hypothenar region 52 of the palm 12 to a region 54 of the palm 12 located between the thumb 20 and the index finger 21. The region 54 of the palm may be for example, a portion opposite the knuckle of the index finger 21. In addition to locations on the palm 12 of the glove 10, the grip pads 50 include locations at the distal ends 60 of the digits 14.

In the embodiment of FIGS. 1 and 3, the grip pads 50 comprise a plurality of geometrically shaped bumps 70. In the disclosed embodiment, the grip pads comprise hexagonal shaped bumps 70. Channels 74 extend in-between each of the geometrically shaped bumps 70. At least one side of each hexagonal bump 70 faces a side of another hexagonal bump across a channel 74 with a channel 74 positioned in between the two opposing sides. The hexagonal shape of each bump 70 is defined along a perimeter of each bump 70 and a substantially flat and smooth upper surface is provided within the perimeter of each bump 70.

The grip pads 50 are configured such that the geometrically shaped bumps 70 are either provided on a thin base layer 72 or are provided directly on the material that forms the other portions of the golf glove 10, such as on the leather or synthetic leather forming the palm portion 12 or digits 14 of the golf glove 10. In the embodiment of FIG. 1, the grip pads 50 on the palm portion 12 of the glove 10 include a thin base layer 72, while the grip pads 50 on the digits 14 do not. Thus, the bumps 70 on the palm portion 12 are situated on top of the thin base layer 72, and the bumps 70 on the digits 14 are situated directly on the leather material forming the digits.

When the grip pads 50 comprise hexagonal bumps 70 provided on a thin silicone base layer 72, the bumps 70 extend outward from the thin base layer 72 such that the plurality of bumps 70 provide additional surface irregularities for the grip pads 50 and thus provide additional gripping qualities for a golfer using the glove. In this case, the channels 74 extend outward from the base layer 72 and are positioned in-between the bumps 70.

The thin base layer 72 is provided on top of the synthetic leather material, and in one embodiment the thin base layer 72 is generally between about 0.10 mm and 2.0 mm in thickness. In at least one embodiment, the thin base layer 72 is about 0.25 mm in thickness. The bumps 70 generally extend outward from the thin base layer 70 between about 0.5 mm and 2.5 mm. The In at least one embodiment, the bumps 70 extend about 1.0 mm outward from the thin base layer 70. On the distal ends 60 of the digits 14, the bumps 70 are provided directly on the synthetic leather without the thin base layer 72. The diameter of the bumps, from side-to-side, is generally between 3.0 and 9.0 mm. In at least one embodiment, the bumps are about 4.0 mm to 6.0 mm in diameter. The channels 74 between the bumps are about 0.25 mm to 1.0 mm in width and have the same height as the bumps themselves. It will be appreciated that the foregoing arrangement and associated ranges for the bumps 70, channels 74, and base layer 72 are merely exemplary of one embodiment, and it will be recognized that numerous other arrangements and ranges for the bumps and base layer are possible.

In the embodiment of FIGS. 1 and 3, the hexagonal shape of the bumps 70 allow for unique configuration of the bumps 70. For example, on the palm portion 12 of the glove 10, the hexagonal bumps 70 are arranged in a circular arrangement, as shown by pads 80 and 82, with six bumps 70 in each circle. In the large grip pad 84 in the hypothenar region 52, the hexagonal bumps 70 may be provided in an overlapping circular arrangement such that one or two bumps 70 are shared between adjacent circles. On the digits 14, the bumps are provided in rows of even numbered and odd numbered bumps. In particular, the bumps are provided in a 1-2-1-2-1 arrangement along the distal end 60 of each digit 14. As set forth above, various methods may be used to provide the grip pads 50 on the golf glove 10. For example, the grip pads 50 may be screen printed on the glove, heat-sealed, embroidered, heat pressed, or laser etched. It will be recognized that other methods of manufacture are also possible.

Although the golf glove has been described with respect to certain preferred embodiments, it will be appreciated by those of skill in the art that other implementations and adaptations are possible. Moreover, there are advantages to individual advancements described herein that may be obtained without incorporating other aspects described above. Therefore, the spirit and scope of any eventual claims should not be limited to the description of the preferred embodiments contained herein.

What is claimed is:

1. A golf glove comprising:

a palm side and a back side, the palm side including a palm portion and a plurality of digits extending from the palm portion, the palm portion and the back side comprised of a first material; and at least one silicone pad provided on the palm side, the silicone pad comprising a plurality of geometrically shaped bumps and channels formed between the geometrically shaped bumps, wherein the at least one silicone pad provides an increased coefficient of friction over that of the first material;

wherein a first plurality of the plurality of geometrically shaped bumps are positioned on tip portions of the digits in alternating rows of even numbered complete geometrically shaped bumps and odd numbered complete geometrically shaped bumps with no partial geometrically shaped bumps positioned in the alternating rows; and wherein the geometrically shaped bumps comprise hexagonal bumps defined along a perimeter of the bumps and a substantially flat surface is provided within the perimeter of the bumps.

2. The golf glove of claim 1 wherein at least one silicone pad covers an exterior portion of the first material on the palm side.

3. The golf glove of claim 1 wherein the at least one silicone pad further includes at least one silicone pad provided on the palm portion.

4. The golf glove of claim 1 wherein the at least one silicone pad comprises a substantially smooth base layer of a silicone material and the plurality of geometrically shaped bumps are provided on the base layer and extend outward from the base layer.

5. The golf glove of claim 1 wherein the bumps are positioned on at least one of the plurality of digits and wherein the bumps are provided directly on the first material.

6. The golf glove of claim 1 wherein geometrically shaped bumps are about 4.0 mm to about 6.0 in diameter.

7. A golf glove comprising:

a palm portion comprised of a first material;

a plurality of digits extending from the palm portion, the plurality of digits also comprised of a first material; and a plurality of grip pads comprised of a second material provided on the palm portion and on the plurality of digits, wherein the each of the plurality of grip pads include a base layer and a plurality of geometrically shaped bumps extending outward from the base layer, wherein empty channels are formed between the geometrically shaped bumps such that the plurality of geometrically shaped bumps are separated on the at least one grip pad by the empty channels;

wherein each of the grip pads on the plurality of digits comprise a first plurality of the plurality of geometrically shaped bumps positioned on tip portions of the digits in alternating rows of even numbered complete geometrically shaped bumps and odd numbered complete geometrically shaped bumps with no partial geometrically shaped bumps positioned in the alternating rows wherein the geometrically shaped bumps comprise hexagonal bumps defined along a perimeter of the bumps and a substantially flat surface is provided within the perimeter of the bumps.

8. The golf glove of claim 7 wherein the plurality of geometrically shaped bumps on the palm portion are positioned a circular arrangement of bumps with no bump positioned in a center of the circular arrangement.

9. The golf glove of claim 7 wherein the base layer is provided directly on the first material.

10. The golf glove of claim 7 wherein the base layer is between about 0.10 mm and 2.0 mm in thickness.

11. The golf glove of claim 10 wherein the base layer is about 0.25 mm in thickness.

12. The golf glove of claim 7 wherein the bumps extend outward from the base layer between about 0.5 mm and 2.5 mm.

13. The golf glove of claim 12 wherein the bumps extend about 1.0 mm outward from the thin base layer.

14. The golf glove of claim 7 wherein the second material is comprised of silicone.

15. A golf glove comprising:

a backhand portion;

a forehand portion comprising a palm portion, a plurality of fingers, and a thumb; and a plurality of hexagonal bumps comprised of a silicone material, the plurality of hexagonal bumps separated by empty channels formed between the hexagonal bumps, wherein the plurality of hexagonal bumps are positioned on the forehand portion and are arranged on the glove such that the plurality of bumps contact a grip of a golf club when the golf club is gripped by a golfer;

wherein a first plurality of the plurality of hexagonal bumps are positioned on tip portions of the fingers and thumb in alternating rows of even numbered complete hexagonal bumps and odd numbered complete hexagonal bumps with no partial hexagonal bumps positioned in the alternating rows; and wherein a hexagonal shape of the bumps is defined along a perimeter of the bumps and a substantially flat surface is provided within the perimeter of the bumps.

16. The golf glove of claim 15 wherein a second plurality of the plurality of hexagonal bumps are positioned on the palm portion in a circular arrangement of six bumps with no hexagonal bump positioned in a center of the circular arrangement, wherein two sides of each bump in the circular arrangement are respectively opposed to a side of an adjacent bump in the circular arrangement.

* * * * *